US008579462B2

(12) United States Patent
VanDuinen et al.

(10) Patent No.: US 8,579,462 B2
(45) Date of Patent: Nov. 12, 2013

(54) LIGHTING ASSEMBLY

(75) Inventors: Micheal VanDuinen, Allendale, MI (US); Richard Camarota, Holland, MI (US)

(73) Assignee: ITC Incorporated, Holland, MI (US)

( * ) Notice: Subject to any disclaimer, the term of this patent is extended or adjusted under 35 U.S.C. 154(b) by 233 days.

(21) Appl. No.: 12/985,022

(22) Filed: Jan. 5, 2011

(65) Prior Publication Data

US 2012/0170258 A1 Jul. 5, 2012

(51) Int. Cl.
*F21S 4/00* (2006.01)
*F21V 5/04* (2006.01)

(52) U.S. Cl.
USPC ..... 362/217.02; 362/219; 362/225

(58) Field of Classification Search
USPC ..... 362/217.02–217.17, 219, 225
See application file for complete search history.

(56) References Cited

U.S. PATENT DOCUMENTS

2004/0184288 A1* 9/2004 Bettis ..... 362/572
2008/0007945 A1* 1/2008 Kelly et al. ..... 362/218
2010/0201239 A1* 8/2010 Mostoller et al. ..... 313/1

* cited by examiner

*Primary Examiner* — Anh T. Mai
*Assistant Examiner* — Nathaniel Lee
(74) *Attorney, Agent, or Firm* — Varnum, Riddering, Schmidt & Howlett LLP

(57) ABSTRACT

Display case lighting comprising a lens with integrally formed features on its interior to mechanically retain LED units therein, at least one LED unit comprising a base and diodes mechanically engaged with the integrally formed features of the lens, an electrical connector to connect the LED units to a power source, and at least one end cap, which preferably incorporates the electrical connector. Sealing implements including a boot seal to seal the electrical connection and a plug cover to cover any unused electrical connectors may be provided, as well as an adhesive to secure the end cover to the lens and seal the connection therebetween, rendering the lighting assembly suitable for use in wet or potentially explosive environments. The externally accessible components may also comprise materials approved for contact with food items.

8 Claims, 6 Drawing Sheets

LIGHTING ASSEMBLY

CROSS-REFERENCE TO RELATED APPLICATIONS

Not Applicable.

FIELD OF THE INVENTION

The invention is in the field of a lighting, particularly, lighting elements suitable for use in display cases.

BRIEF SUMMARY OF THE INVENTION

The invention comprises a lighting assembly having an elongated lens comprising a tube with preferably at least one open end and having integrally formed retaining features on the interior of the tube, where at least a portion of the lens is transparent to visible light, an LED lighting unit comprising a base and light emitting diodes which is mechanically engaged with the retaining features on the interior of the tube, an electrical connector which is electrically connected to the LED lighting unit, and which is capable of receiving electrical power from an electrical power source and transmitting such incoming electrical power to the LED lighting unit, and preferably an end cap which is mechanically engaged with the at least one open end of the lens.

The lighting assembly preferably comprises externally accessible components manufactured using materials approved by relevant regulators for contact with food items and which are readily able to be cleaned. The lighting assembly is also preferably manufactured as a sealed unit, such that it can be installed and used in potentially explosive or wet environments. Further the lighting assembly is preferably manufactured having an integrated light shield as part of the lens, and so that a single lens can be efficiently used with single and dual LED configurations.

DETAILED DESCRIPTION OF THE PREFERRED EMBODIMENTS

Figure 1:
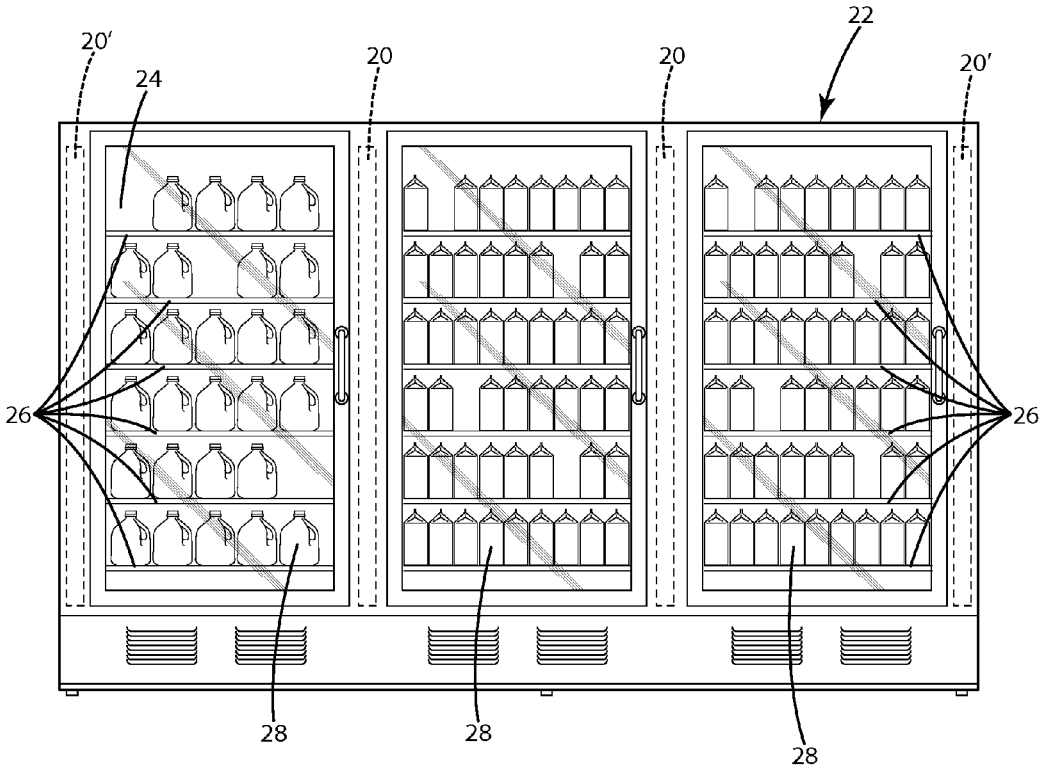
FIG. 1 is a front view showing the position of the lighting assembly in a display case, with the lighting assembly shown in dotted lines.
Figure 2:
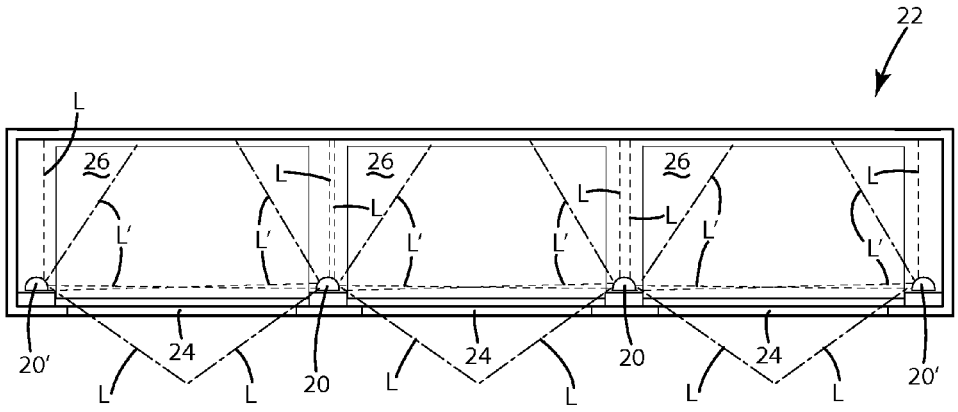
FIG. 2 is a top view showing the position of the lighting assembly in a display case, with the lighting assembly shown in dotted lines.
Figure 3:
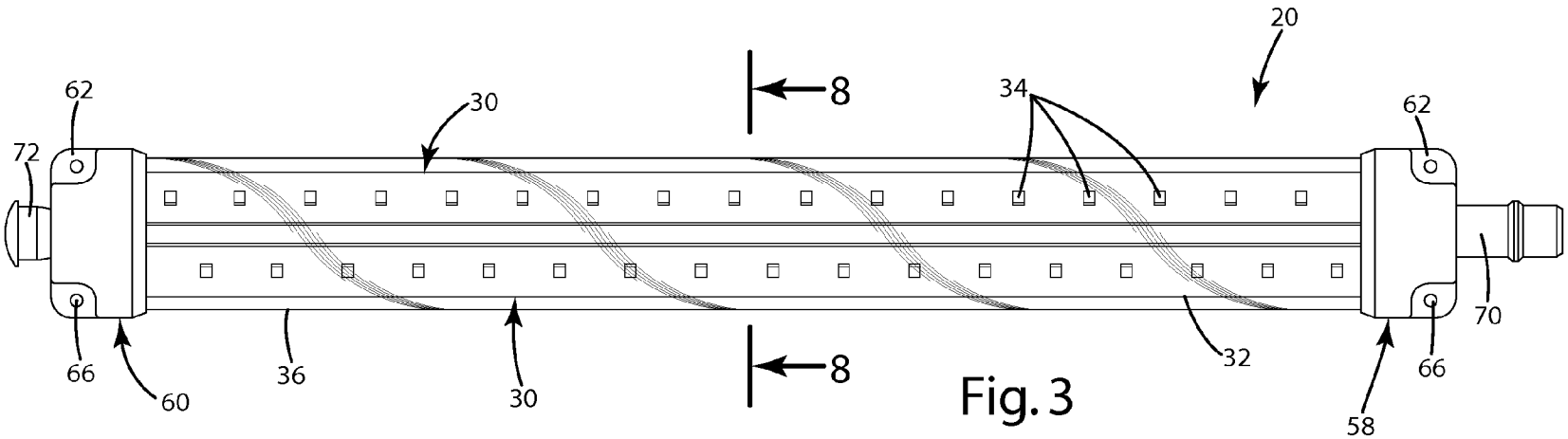
FIG. 3 is a front view of the display case lighting assembly.
Figure 4:
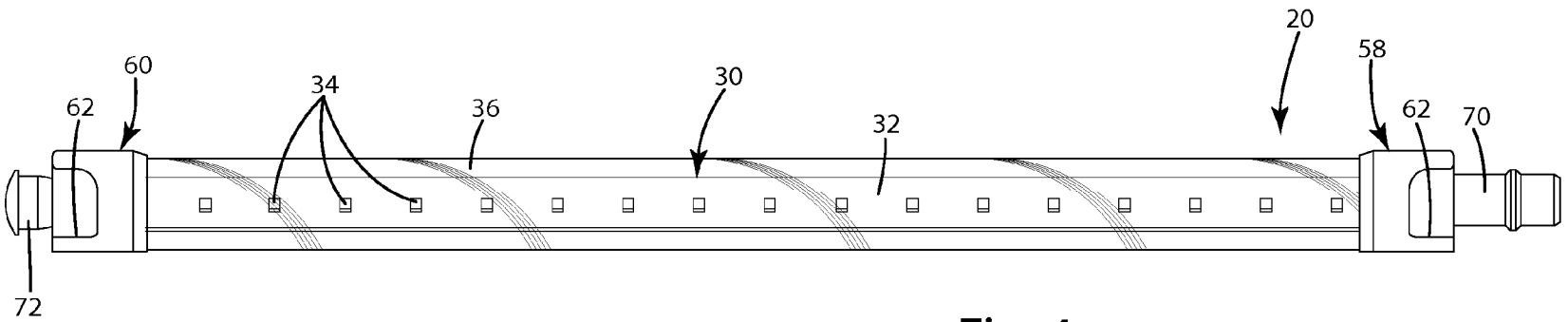
FIG. 4 is a side view of the display case lighting assembly.
Figure 5:
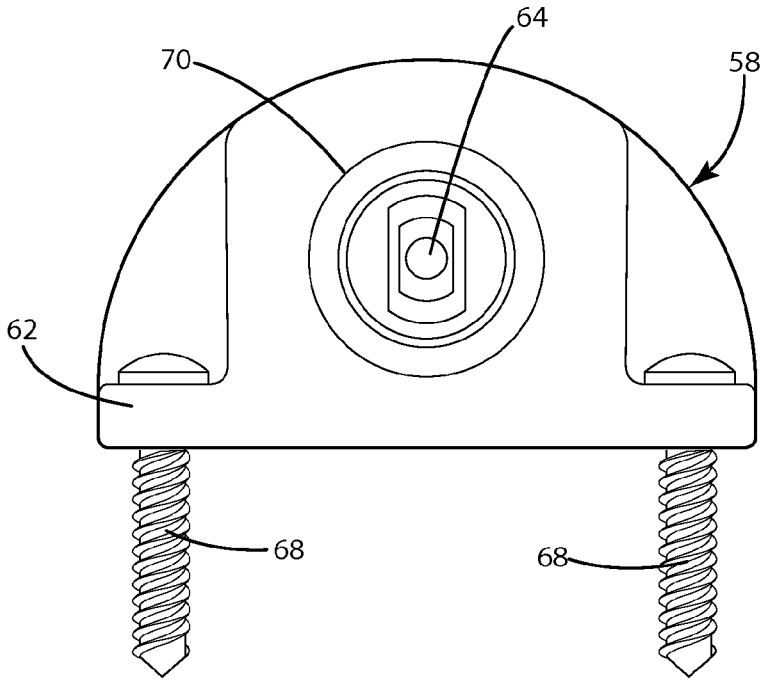
FIG. 5 is an end view of the display case lighting assembly on the end that is to be wired.
Figure 6:
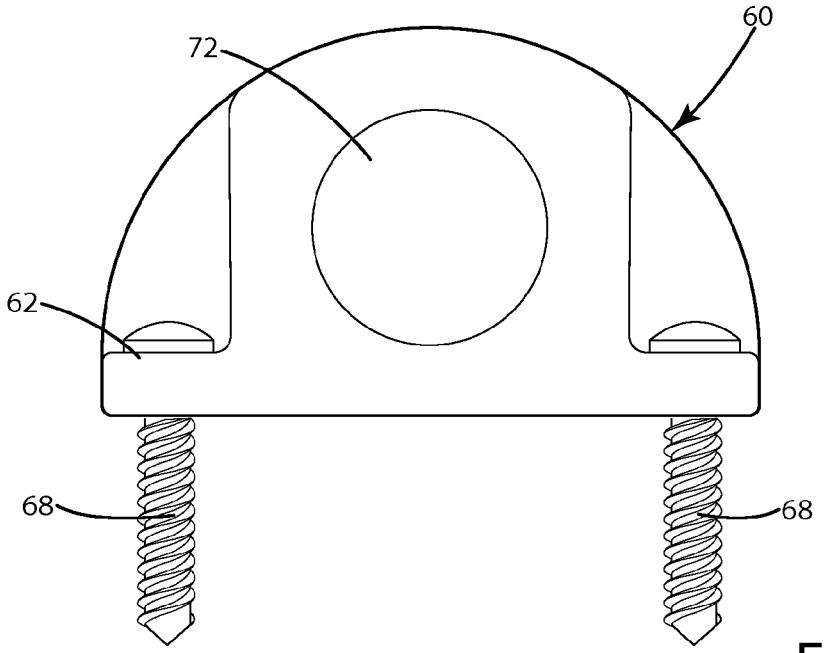
FIG. 6 is an end view of the display case lighting assembly on the end that will not be connected to a power source, with the boot in place.
Figure 7:
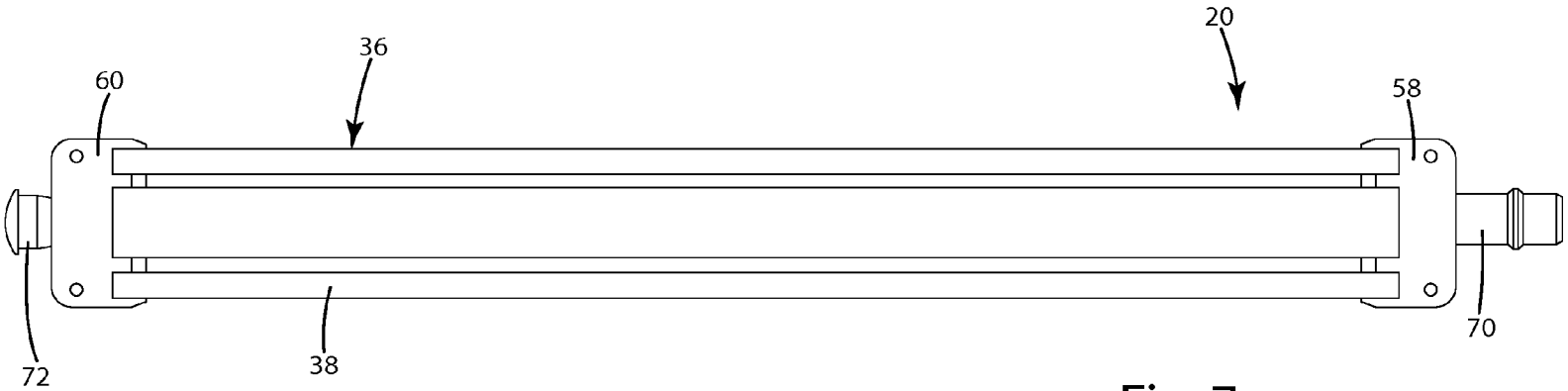
FIG. 7 is a rear view of the display case lighting assembly.

The lighting assembly 20 described herein is an elongated LED lighting assembly 20 which can be used in place of fluorescent or other lighting apparatus in locations where even, efficient lighting is desired, and preferably in locations which may come into contact with food or that may require cleaning or involve liquids or that are potentially explosive. Lighting assembly 20 is particularly suitable for use in locations such as display cases 22, having clear doors 24 and shelves 26 to hold product 28, where lighting on the front of products 28 is desired. (FIGS. 1-2) Particularly, lighting assemblies 20 are suitable for use in refrigerated or frozen display cases 22, such as the type used to display chilled food and beverages, where the use of fluorescent lighting can be energy-intensive and inefficient, not to mention costly and potentially toxic if a fluorescent light is broken.

One preferred embodiment of lighting assembly 20 includes two elongated LED units 30 affixed inside a lens 36, having two end caps 58, 60 fitted on the ends of lens 36 and electrically connected to LED units 30, wherein end caps 58, 60 further include electrical connectors 64 to connect lighting assembly 20 to an incoming power supply. (FIGS. 3-7)

Each LED unit 30 comprises an elongated generally rectangular base 32, with light emitting diodes 34 spaced along the length of base 32. LED units 30 as described herein preferably include a plurality of small diodes 34 along the length of base 32, to limit the power consumption and heat generation of individual diodes 34 and to disburse the light and generated heat along the length of base 32 and lighting assembly 20. LED units 30 may include a printed circuit board, wherein diodes 34 are printed onto base 32 for low profile design and a small, efficient size. Such bases 32 and printed diodes 34 may be manufactured in various lengths and widths, to accommodate the desired height and size of lighting assembly 20.

Figure 8:
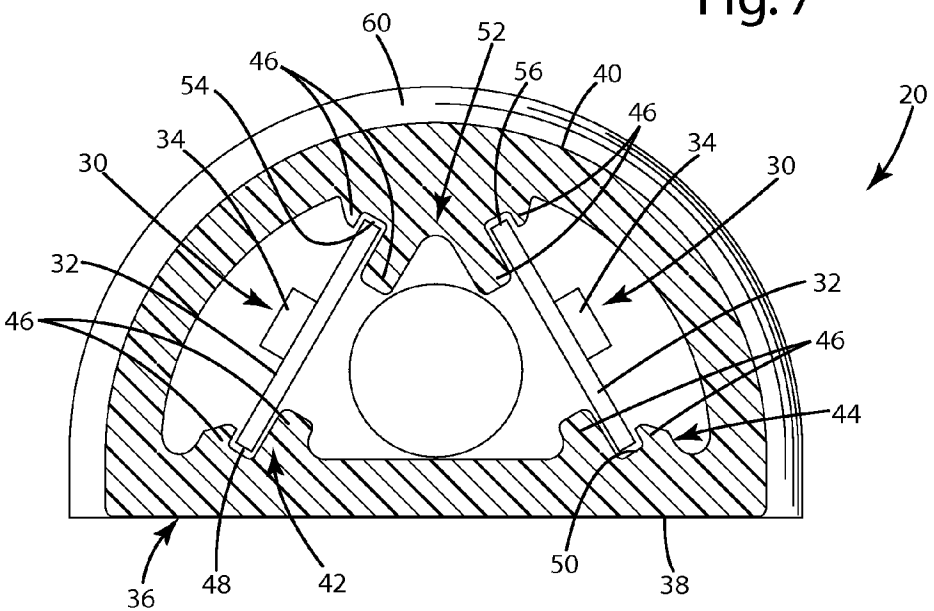
FIG. 8 is a cross sectional view of the display case lighting assembly, taken along line 8-8 of FIG. 3.
Figure 9:
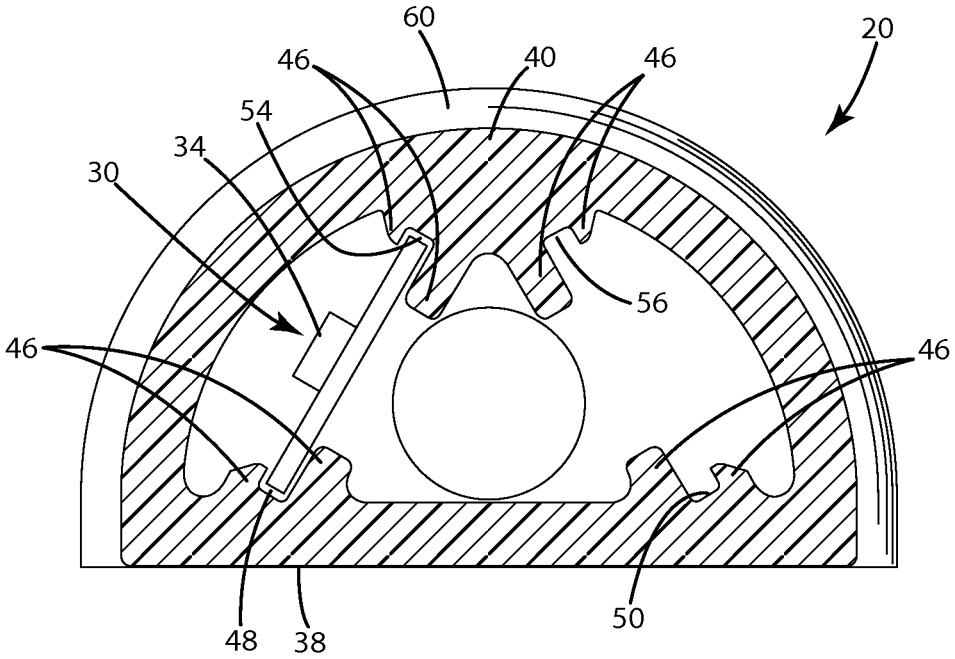
FIG. 9 is a cross sectional view of the display case lighting assembly taken along line 8-8 of FIG. 3, with one of the LED lighting elements removed.

Lens 36 comprises a hollow column of material, generally in the shape of a "D," with flat side 38 to facilitate mounting, and curved side 40 through which light L is transmitted. (FIGS. 8, 9) Lens 36 further comprises guides to mount LED units 30 on its interior. Two single mounts 42, 44 extend from flat side 38 toward the apex of curved side 40, with each single mount 42, 44 comprising two ridges 46 extending the length of lens 36 and defining a channel 48, 50 therebetween. A double mount 52 extends from the apex of curved side 40 toward flat side 38, wherein one half of double mount 52 comprises two ridges 46 defining a channel 54 and the other half of double mount 52 comprises two ridges 46 defining a channel 56. Channels 48, 54 are sized and positioned relative to each other adequately to receive one LED unit 30, and channels 50, 56 are sized and positioned to receive to one another adequately to receive another LED unit 30, with each LED unit 30 having one side edge thereof retained in single mount 42, 44 and the opposite side edge thereof retained in one half of double mount 52. LED units 30 are installed in lens 36 with diodes 34 facing outward.

Figure 10:
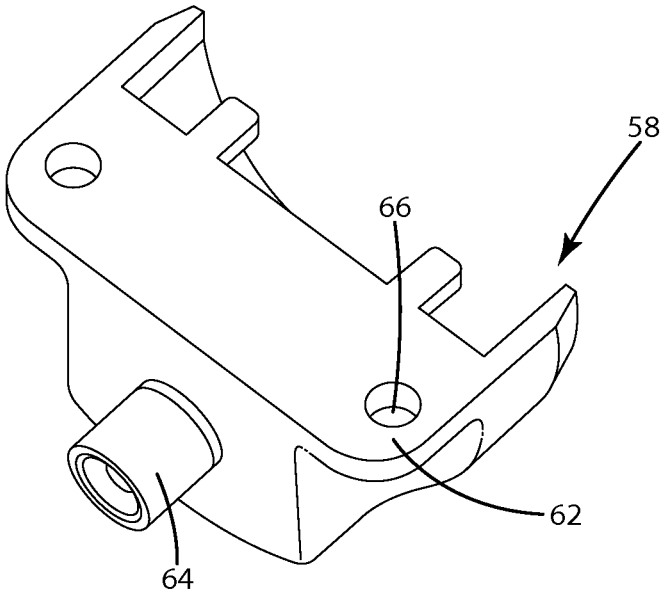
FIG. 10 is a top perspective view of the end cap used on the display case lighting assembly.

Two end caps 58, 60 are placed over the end of lens 36, in electrical connection with LED units 30 and are sealed thereto with some type of adhesive, glue, or other sealing agent, which is preferably water resistant and UV-stable. Each end cap 58, 60 fits over one end of lens 36, with a shape and features to interact with the outer circumference of lens 36 and provide a sealed connection therewith, and further comprises a mounting plate 62 and an electrical connector 64. (FIG. 10) End caps 58, 60 are preferably identical so that lighting assembly 20 can be mounted with either end at the top and either end at the bottom.

Mounting plate 62 has at least one hole 66, which permits lighting assembly to be mounted on a flat surface, such as the space between display cases 22, by fastening a screw 68 or other device through hole 66 in mounting plate 62. Electrical connector 64 is preferably a barrel connection jack, which is adapted to receive power from an incoming power source and is electrically connected to LED unit 30, such that electrical connector 64 is capable of supplying DC electrical power to LED unit 30, preferably supplying 12-24 Volts DC power to LED unit 30.

Figure 11:
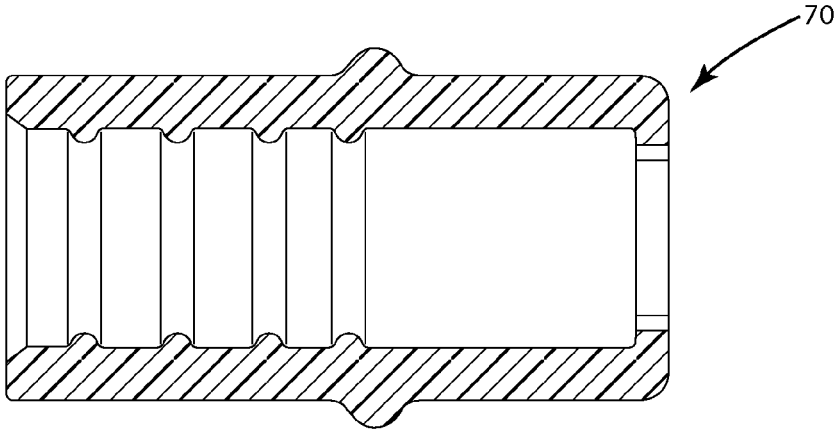
FIG. 11 is a cross sectional view of the boot seal used in the barrel fitting on the end cap.
Figure 12:
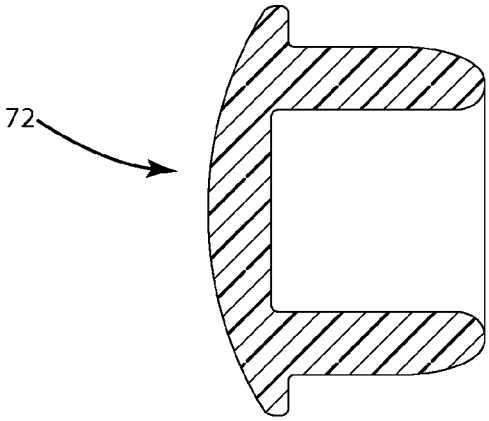
FIG. 12 is a cross sectional view of the plug cover used in the barrel fitting on the end cap.

To seal the connection between end cap 58 with electrical connector 64 and the incoming power source, a boot seal 70, comprising a generally cylindrical piece of non-conductive material, is placed over the connection. (FIG. 11) Additionally, due to the preferred identical construction of the end caps 58, 60, electrical connector 64 on the second end cap 60, which is not being used to supply power to LED unit 30, may be covered with a small, non-conductive plug cover 72, which operates as a removable seal to protect the exposed electrical connection. (FIG. 12) Also due to the identical construction of end caps 58, 60, the incoming power source may come from either the top or the bottom, or lighting assembly 20 can be reversed from its original orientation upon simply switching boot seal 70 and plug cover 72.

With regard to construction and manufacturing of lighting assembly 20, as described above, LED units 30 may be manufactured using known methods, to produce elongated LED units 30 of the desired length to illuminate the desired space. Further, multiple LED units 30 can be electrically connected and installed along the length of a single lens 36. LED units 36 may also be manufactured to provide light of various qualities and colors of LED lighting.

When lighting assembly 22 is intended for use in display cases 22 containing food products 28, the components of lighting assembly 20 which may come into contact with products 28 are preferably safe for food contact, to reduce the risk of food contamination and so that further shielding of lighting assembly 20 is not necessary. These components include lens 36, end caps 58, 60, boot seal 70 and plug cover 72.

Lens 36 is preferably manufactured using shatter-proof or shatter resistant material which is transparent to the light being generated by LED units 30 and which provides durable protection for LED units 30. One example of such a material is Eastman Tritan Copolyester TX2001, sold by the Eastman Chemical Company, which is formulated to allow for extrusion into a durable product with a high degree of clarity, and which can be used repeatedly for food contact articles. The extruded material may also be provided with a thickness which provides extra protection to the LED units 30 within lens 36, such as a thickness of 2.5 mils, which provides additional durability as compared to traditional fluorescent lighting.

Figure 13:
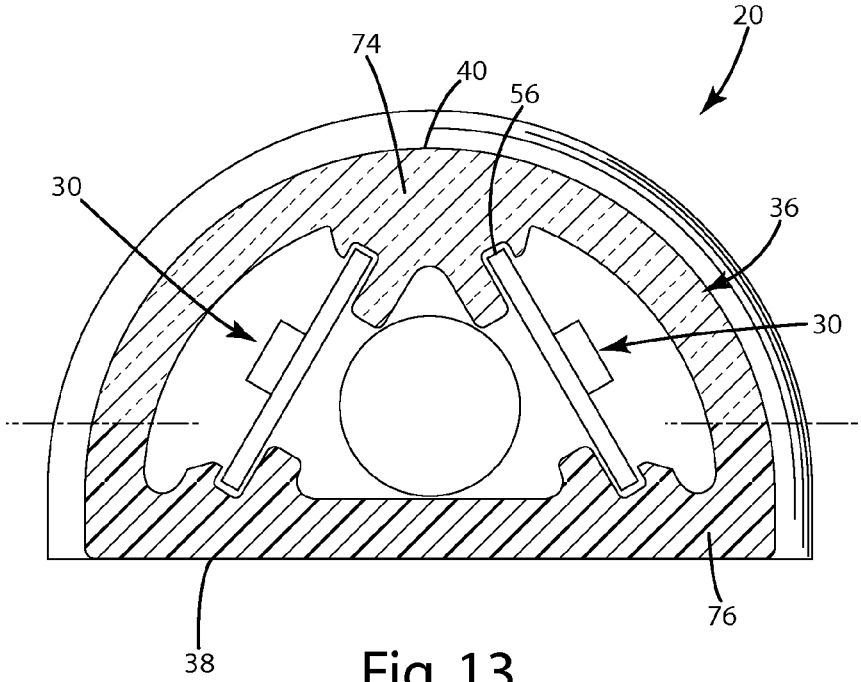
FIG. 13 is a cross sectional view of the display case lighting assembly, taken along line 8-8 of FIG. 3, showing the use of coextruded lens materials.

A preferred method of manufacturing lens 36 is extrusion, or if multiple materials are used, coextrusion, of a polymeric material into a tube of the desired cross sectional shape. Lens 36 can be cut to a desired length, with some preferred lengths for use in refrigerated case being from about 12 inches to about 60 inches. Lens 36 may be manufactured using one material which is transparent to visible light, or may contain two or more materials, with the two or more materials having varying transparency to visible light. For example lens 36 may comprise a generally transparent material 74 and a more opaque material 76, with the more opaque material 76 making up flat side 38 of lens 36, and optionally some portion of the adjacent curved side 40 so as to operate as a light shield and narrow the field of light L emitted from lighting assembly 20. (FIG. 13) If a more opaque material 76 is used for a portion of lens 36, additional pigment can be added to the first material 74 to make opaque material 76, or a separate compatible opaque material 76 may be used.

Extrusion of lens 36 allows for the ready shaping of the cross section of lens 36, and readily permits formation of channels 48, 50, 54, 56 which extend along the entire length of lens 36 to secure LED units 30. However, other methods of production of lens 36, such as molding, would permit the use of alternate integrally formed structures to secure LED unit 30, such as intermittent notches or fingers to guide LED unit 30 and secure it into position within lens 36.

End caps 58, 60 are preferably manufactured using a durable, flexible material which is able to be sealed against lens 36 and adhered thereto using a compatible adhesive, and which retains the flexibility and sealing ability even in cold environments where lighting assembly 20 may be used. One example of such a material is a thermoplastic vulcanizate Santoprene TPV 241-80, manufactured by Exxon Mobile, which is a flexible, low compression set material which is available in an NSF grade to permit contact with food items. End caps 58, 60 are preferably hermetically sealed to lens 36, which permits lighting assembly 20 to be used in explosion proof environments and wet environments, preferably with an International Protection Rating of IP67 (dust tight and able to be immersed in up to 1 meter of water).

Boot seal 70 and plug cover 72 are preferably manufactured using a material which will conform to end caps 58, 60, and which is also available with NSF food grade certification, such as a silicone material.

Lighting assembly 20 can be attached to the mounting surface in a number of different ways, and does not necessarily require mounting holes 66 in end caps 58, 60. Additional methods of affixing lighting assembly 20 to a mounting surface include, but are not limited to, nails, brackets, adhesives, glues, loops or other fasteners which hold lighting assembly 20 in place using friction, hook and loop fasteners, or any other method for securing, preferably in a removable fashion, lighting assembly 20 to the mounting surface. Methods of mounting lighting assembly 20 may also depend upon the desired permanence of the mount, whether it is being used to retrofit a previously used lighting connection, and whether it is intended to be readily re-configured by end users.

When a lighting assembly 20 is intended to illuminate adjacent display cases 22, to maximize efficiency LED units 30 are arranged at an angle of approximately 60 degrees to each other, with single mounts 42, 44 and double mount 52 of lens 36 positioned to hold LED units 30 in this position. Since LED diodes 34 on LED unit 30 generally have a field of illumination L which extends outward at an angle of approximately 120 degrees from the face of diode 34, the angle of the LED unit 30, combined with the field of illumination L, results in light coverage which extends outward from lighting assembly 20 at an angle of greater than 180 degrees in each direction, to illuminate each adjacent display case 22. (FIG. 2) This field of illumination L results in light which illuminates the front of products 28 in display case 22, while projecting only a small amount of light out into the aisle. The angle of LED units 30 can be modified, to cast light with the desired field of coverage, and LED units 30 can be placed asymmetrically to cast light in the desired field of illumination.

Additionally, when a more opaque material 76 is used as a portion of lens 36 to create a light shield which includes the flat side 38 of lens 36 and a portion of each curved side 40, the field of illumination L may be reduced, such that the light extends outward at a 180 degree angle or less, as desired, as illustrated by L'. Depending upon the end use of lighting assembly 20, a smaller field of illumination L may be desired, e.g., to reduce the amount of glare that would reach the eyes of a consumer outside of display case 22.

When used for a refrigerated case, each LED unit 30 within lighting assembly 20 preferably illuminates an area which is about 4-6 inches deep (the front of shelves 26 with products 28), and which is approximately 20 inches wide. Since there are preferably two lighting assemblies 20 to illuminate each display case 22, one from each side, the total width of the case may be greater than 20 inches. Certain commonly used widths for refrigerated display cases 22 are between about 24 inches and about 29 inches. Because of the bell curve distribution of LED lighting, the use of two LED units 30 projecting from different sides of display case 22 results in an even light over the front of display case 22.

The use of LED units 30 mounted at approximately 60 degrees, as described above, provides an additional benefit, in that a triangular air-filled space is formed between the back sides of LED units 30, wherein the space functions as a heat sink, such that a separate heat sink is not necessary to cool lighting assembly 20. The lower generation of heat by LED units 30, combined with the space is generally sufficient to maintain proper operating parameters for lighting assembly 20.

Another preferred embodiment of lighting assembly 20' for use in a vertical orientation at the end of a series of display cases 22, includes one elongated LED unit 30 placed within lens 36, with LED unit 30 directed toward the adjacent shelves 26 in display case 22, with two end caps 58, 60, one at each end of lens 36. (FIGS. 1-2) This configuration, which is identical to the previously described preferred embodiment except that only one LED unit 30 is placed inside lens 36, can be used on either end of a series of display cases 22, projecting light L to either side, by flipping lighting assembly 20' top to bottom. Lighting assembly 20' may also be placed horizontally at the top or bottom of display case. Due to the identical construction of lens 36 for use on the end of a series of display cases 22, and the identical construction of end caps 58, 60, a single type of LED unit 30, lens 36 and end cap 58, 60 can be used for all lighting assemblies 20, regardless of intended location, reducing inventory requirements and manufacturing tooling costs.

Lighting assembly 20 described herein is also suitable for use in other applications, where even, energy efficient lighting is desired. Due to the sealed nature of lighting assembly 20, and lower heat generation of LED lighting as opposed to traditional fluorescent lighting, lighting assembly 20 may also be suitable for use in other locations where traditional fluorescent lighting poses certain risks. For example, in potentially explosive environments, or environments subject to repeated cleaning with potentially harsh or corrosive cleaning agents.

LED lights also use less energy than traditional fluorescent lights, provide a faster start-up time in cold environments, and provide a pleasing light which can be customized to certain color temperatures, such as an LED color temperature of from about 3,800 degrees Kelvin to about 4,400 degrees Kelvin, which is a desirable color range for the illumination of grocery items in a refrigerated case 22. LED light L is emitted from diodes 34 in a bell curve, such that the intersecting light from an LED unit 30 on the right and an LED unit 30 on the left create an even light across the front of display case 22.

Of course it is understood that the above is a description of preferred embodiments, and that various changes and alterations can be made to the lighting assembly without departing from the spirit and broader aspects of the invention.

What is claimed is:

1. A lighting assembly, comprising:

an elongated lens, comprising a tube having integrally formed retaining features on the interior of the tube, wherein at least a portion of the lens is transparent to visible light;

an LED lighting unit, comprising a base and light emitting diodes, wherein the LED lighting unit is mechanically engaged with the integrally formed retaining features on the interior of the tube;

an electrical connector which is electrically connected to the LED lighting unit and which is capable of receiving electrical power from an electrical power source and transmitting such incoming electrical power to the LED lighting unit;

said lens has at least two open ends, an end cap is mechanically engaged to each of said open ends, and said electrical connector is incorporated into at least one of said end caps; and said lens further has integrally formed mechanical features so as to secure two LED lighting units at approximately a 60 degree angle to each other, and said lens further having a cross section generally comprising a flat side and a curved side, and wherein said end caps further comprise mounting plates.

2. A lighting assembly, comprising:

an elongated lens, comprising a tube having integrally formed retaining features on the interior of the tube, wherein at least a portion of the lens is transparent to visible light;

an LED lighting unit, comprising a base and light emitting diodes, wherein the LED lighting unit is mechanically engaged with the integrally formed retaining features on the interior of the tube;

an electrical connector which is electrically connected to the LED lighting unit and which is capable of receiving electrical power from an electrical power source and transmitting such incoming electrical power to the LED lighting unit said lens has at least two open ends, an end cap is mechanically engaged to each of said open ends, and wherein said electrical connector is incorporated into at least one of said end caps; and said lens further has integrally formed features so as to secure two LED units, wherein the LED units are asymmetrically arranged within the lens.

3. A lighting assembly, comprising:

an elongated lens, comprising a tube having integrally formed retaining features on the interior of the tube, wherein at least a portion of the lens is transparent to visible light an LED lighting unit, comprising a base and light emitting diodes, wherein the LED lighting unit is mechanically engaged with the integrally formed retaining features on the interior of the tube;

an electrical connector which is electrically connected to the LED lighting unit and which is capable of receiving electrical power from an electrical power source and transmitting such incoming electrical power to the LED lighting unit; and at least a portion of said lens is a light shield, having less transparency to light emitted by the LED lighting unit.

4. The lighting assembly of claim 3, wherein the lens has a cross section generally comprising a flat side and a curved side, and wherein the flat side of the lens comprises the light shield.

5. The lighting assembly of claim 4, wherein at portion of the curved side further comprises the light shield.

6. The lighting assembly of claim 5, wherein the lens further comprises integrally formed mechanical retaining features to hold two LED lighting units at angles which are asymmetrical with respect to each other within the lens.

7. The lighting assembly of claim 6, wherein the light shield comprises a predetermined portion of the curved side of the lens, so as to limit projection of light from the LED lighting units to a plane that is generally less than or equal to about 180 degrees outward from the flat side of the lens.

8. The lighting assembly of claim 5, wherein the lens further comprises integrally formed mechanical retaining features to hold two LED lighting units at approximately a 60 degree angle to each other, such that the LED lighting units generally form a triangle with the flat side of the lens, with the diodes directed outwards from the triangle toward the curved side of the lens.

* * * * *